US008491734B2

(12) United States Patent
Honda et al.

(10) Patent No.: US 8,491,734 B2
(45) Date of Patent: Jul. 23, 2013

(54) PROCESS OF PRODUCTION AND PRODUCTION SYSTEM OF HIGH STRENGTH GALVANNEALED STEEL SHEET

(75) Inventors: Kazuhiko Honda, Kimitsu (JP); Koki Tanaka, Futtsu (JP)

(73) Assignees: Nippon Steel & Sumitomo Metal Corporation, Tokyo (JP); Usinor, Puteaux (FR)

( * ) Notice: Subject to any disclaimer, the term of this patent is extended or adjusted under 35 U.S.C. 154(b) by 858 days.

(21) Appl. No.: 10/568,997

(22) PCT Filed: Aug. 19, 2004

(86) PCT No.: PCT/JP2004/012223

§ 371 (c)(1),
(2), (4) Date: Feb. 16, 2006

(87) PCT Pub. No.: WO2005/017214

PCT Pub. Date: Feb. 24, 2005

(65) Prior Publication Data

US 2007/0051438 A1 Mar. 8, 2007

(30) Foreign Application Priority Data

Aug. 19, 2003 (JP) ..... 2003-207881

(51) Int. Cl.
*C23C 2/28* (2006.01)

(52) U.S. Cl.
USPC ..... 148/533; 148/634

(58) Field of Classification Search
USPC ..... 266/103; 148/533, 634
See application file for complete search history.

(56) References Cited

U.S. PATENT DOCUMENTS

| | | | | |
|---|---|---|---|---|
| 4,437,905 | A * | 3/1984 | Nitto et al. | 148/623 |
| 2003/0047255 | A1 | 3/2003 | Delaunay et al. | |

FOREIGN PATENT DOCUMENTS

| | | |
|---|---|---|
| JP | 55 085622 | 6/1980 |
| JP | 02-038549 | 2/1990 |
| JP | 04-202632 | 7/1992 |
| JP | 2513532 | 7/1996 |
| JP | 09-324209 | 12/1997 |
| JP | 09-324210 | 12/1997 |
| JP | 2000 290730 | 10/2000 |

(Continued)

OTHER PUBLICATIONS

Matsumoto et al. "Effect of Reduction-heating Conditions of Wetting Characteristics with Molten Zinc of IF-steels Containing Mn and P" Nisshin Technical Report No. 78 (1998), pp. 1-8.

*Primary Examiner* — Weiping Zhu
(74) *Attorney, Agent, or Firm* — Kenyon & Kenyon LLP

(57) ABSTRACT

A process of production for producing a high strength galvannealed steel sheet by a hot-dip galvanized steel sheet production equipment using an all radiant tube type annealing furnace and a production equipment for the same are provided, comprising continuously hot-dip galvanizing a high strength steel sheet having a content of Si of 0.4 to 2.0 wt % during which making the atmosphere of the reducing zone an atmosphere containing $H_2$ to 1 to 60 wt % and comprised of the balance of $N_2$, $H_2O$, $O_2$, $CO_2$, CO, and unavoidable impurities, controlling the log ($PCO_2/PH_2$) of the carbon dioxide partial pressure and hydrogen partial pressure in the atmosphere to log ($PCO_2/PH_2$)≦−0.5 and the log ($PH_2O/PH_2$) of the water partial pressure and hydrogen partial pressure to log ($PH_2O/PH_2$)≦−0.5, and controlling the log ($P_T/PH_2$) of the total partial pressure $P_T$ of the carbon dioxide partial pressure $PCO_2$ and water partial pressure $PH_2O$ and the hydrogen partial pressure to −3≦log ($P_T/PH_2$)≦−0.5.

3 Claims, 2 Drawing Sheets

FOREIGN PATENT DOCUMENTS

| | | | |
|---|---|---|---|
| JP | 2001 279412 | | 10/2001 |
| JP | 2001279412 | A * | 10/2001 |
| JP | 2001 323355 | | 11/2001 |
| JP | 2001-323355 | | 11/2001 |
| JP | 2009-209397 | | 9/2009 |

* cited by examiner

PROCESS OF PRODUCTION AND PRODUCTION SYSTEM OF HIGH STRENGTH GALVANNEALED STEEL SHEET

TECHNICAL FIELD

The present invention relates to a process of production and production system of a high strength galvannealed steel sheet, more particularly relates to a plated steel sheet able to be utilized for various applications, for example, a steel sheet for a building material or an automobile.

BACKGROUND ART

As a plated steel sheet with a good corrosion resistance, there is a galvannealed steel sheet. This galvannealed steel sheet usually is produced by degreasing the steel sheet, then preheating it in a non-oxidizing furnace, reduction annealing it in a reducing furnace to clean the surface and secure the quality, dipping it in a hot-dip galvanizing bath, controlling the amount of deposition, then alloying. Due to its characteristics of superior corrosion resistance, plating adhesion, etc., it is widely used for automobile, building material, and other applications.

In particular, in recent years, in the automobile sector, galvanized steel sheets have to be made higher in strength to achieve both the function of protecting passengers at the time of collision and reducing weight for the purpose of improving fuel efficiency.

Further, recently, to make the reaction at the surface of the steel sheet at the time of annealing more uniform and improve the plating appearance, production systems for galvanized steel sheet using all radiant tube type annealing furnaces have spread in use.

To make the steel sheet higher in strength without reducing the workability, addition of elements like Si, Mn, and P is effective. These elements are selectively oxidized in the reduction annealing step and become concentrated at the surface of the steel sheet. In particular, oxides of Si concentrated at the surface of the steel sheet cause the wettability of the steel sheet and molten zinc to drop. In extreme cases, the molten zinc will not adhere to the steel sheet.

Therefore, to plate with molten zinc a steel sheet to which an element like P has been added, use has been made of the method of making the thickness of the oxide film of the iron a suitable range to keep down the production of oxide layers of elements such as Si, Mn, and P and improve the wettability (for example, see Japanese Patent No. 2513532) or the method of pre-plating to improve the plating wettability (for example, see Japanese Unexamined Patent Publication (Kokai) No. 2-38549).

Further, the inventors proposed the method of production comprising suitably controlling the reducing atmosphere to cause internal oxidation of SiO so as to improve the plating wettability (for example, see Japanese Unexamined Patent Publication (Kokai) No. 2001-323355).

However, the technology disclosed in Japanese Patent No. 2513532 and Japanese Unexamined Patent Publication (Kokai) No. 2001-323355 is technology using a Sendzimir type hot-dip galvanizing steel sheet production system for heating in a non-oxidizing atmosphere and annealing in a reducing atmosphere and cannot be used in a manufacturing equipment of hot-dip galvanized steel sheet using an all radiant tube type annealing furnace. Further, in the technology disclosed in Japanese Unexamined Patent Publication (Kokai) No. 2-38549, a pre-plating system is necessary. When there is no installation space, it cannot be used. Further, a rise in cost due to the installation of the pre-plating system is unavoidable.

DISCLOSURE OF INVENTION

Therefore, the present invention solves the above problem and proposes a process of production of a high strength galvannealed steel sheet by a manufacturing equipment of hot-dip galvanized steel sheet using an all radiant tube type annealing furnace and a production system for the same.

The inventors engaged in intensive research on a process of production for producing a high strength galvannealed steel sheet by a manufacturing equipment of hot-dip galvanized steel sheet using an all radiant tube type annealing furnace and as a result discovered that by making the atmosphere in the reducing zone an atmosphere containing $H_2$ in an amount of 1 to 60 wt % and comprising the balance of $N_2$, $H_2O$, $O_2$, $CO_2$, CO, and unavoidable impurities, controlling the log ($PCO_2/PH_2$) of the carbon dioxide partial pressure and hydrogen partial pressure in the atmosphere to log ($PCO_2/PH_2$) $\leqq -0.5$ and the log ($PH_2O/PH_2$) of the water partial pressure and hydrogen partial pressure to log ($PH_2O/PH_2$) $\leqq -0.5$, and controlling the log ($P_T/PH_2$) of the total partial pressure $P_T$ of the carbon dioxide partial pressure $PCO_2$ and water partial pressure $PH_2O$ and the hydrogen partial pressure to $-3 \log (P_T/PH_2) \leqq -0.5$, it is possible to produce a high strength galvannealed steel sheet. Further, they discovered that by filling the all radiant-tube type annealing furnace with a gas comprised 1 to 100 wt % of $CO_2$ and the balance of $N_2$, $H_2O$, $O_2$, CO, and unavoidable impurities, it is possible to produce a high strength galvannealed steel sheet.

That is, the gist of the present invention is as follows:

(1) A process of production of a high strength galvannealed steel sheet comprising continuously plating by molten zinc a high strength steel sheet having a content of Si of 0.4 to 2.0 wt % during which making the atmosphere of the reducing zone an atmosphere containing $H_2$ to 1 to 60 wt % and comprised of the balance of $N_2$, $H_2O$, $O_2$, $CO_2$, CO, and unavoidable impurities, controlling, in the atmosphere, the log ($PCO_2/PH_2$) of the carbon dioxide partial pressure and hydrogen partial pressure to log ($PCO_2/PH_2$) $-0.5$, the log ($PH_2O/PH_2$) of the water partial pressure and hydrogen partial pressure to log ($PH_2O/PH_2$) $\leqq -0.5$, and the log ($P_T/PH_2$) of the total partial pressure $P_T$ of the carbon dioxide partial pressure $PCO_2$ and water partial pressure $PH_2O$ and the hydrogen partial pressure to $-3 \log (P_T/PH_2) \leqq -0.5$, performing the annealing in the reducing zone in a ferrite-austenite two-phase temperature region at 720° C. to 880° C., then cooling by a plating bath and performing the galvanizing so as to form a hot-dip galvanizing layer on the surface of the cold rolled steel sheet, then heating for alloying the steel sheet on which the hot-dip galvanizing layer is formed at 460 to 550° C., it is possible to produce a high strength galvannealed steel sheet.

(2) A process of production of a high strength galvannealed steel sheet as set forth in (1), characterized by performing the galvannealed in a hot-dip galvanizing bath of a composition comprised of an effective Al concentration in the bath of at least 0.07 wt % and the balance of Zn and unavoidable impurities and performing the alloying at a temperature (° C.) satisfying $$450 \leqq T \leqq 410 \times \exp(2 \times [\text{Al } \%])$$

where, [Al %]: effective Al concentration (wt %) in the hot-dip galvanizing bath (3) A process of production of a high strength galvannealed steel sheet as set forth in (1) or (2) superior in bondability, characterized by being performed at an effective Al concentration (wt %) in the bath satisfying the effective Al concentration in the bath of:

$$[Al\ \%] \leqq 0.092 - 0.001 \times [Si\ \%]^2$$

where, [Si %]: Si content in steel sheet (wt %)

(4) A manufacturing equipment of hot-dip galvanized steel sheet comprising providing a hot-dip galvanizing bath and continuously plating a steel sheet by molten zinc, said equipment for production of a hot-dip galvanizing steel sheet for working the process of production of a high strength galvannealed steel sheet described in (1) characterized by making the annealing furnace an all radiant tube type annealing furnace and providing an apparatus for introducing into the annealing furnace a gas containing $CO_2$ in an amount of 1 to 100 wt % and comprised of the balance of $N_2$, $H_2O$, $O_2$, CO, and unavoidable impurities.

(5) A manufacturing equipment of hot-dip galvanized steel sheet comprising providing a hot-dip galvanizing bath and continuously plating a steel sheet by molten zinc, said equipment for production of a hot-dip galvanizing steel sheet for working the process of production of a high strength galvannealed steel sheet described in (1) characterized by making the annealing furnace an all radiant tube type annealing furnace and providing an apparatus for burning CO or a hydrocarbon in the annealing furnace and producing a gas containing $CO_2$ in an amount of 1 to 100 wt % and comprised of the balance of $N_2$, $H_2O$, $O_2$, CO, and unavoidable impurities.

Further, in the present invention, it is possible to produce a high strength galvannealed steel sheet aimed at by the present invention under the conditions defined below:

1) In the process of production of a high strength galvannealed steel sheet as set forth in any of the above (1) to (5), the sheet is cooled from the maximum reached temperature to 650° C. by an average cooling rate of 0.5 to 10° C./sec and then from 650° C. to the plating bath by an average cooling rate of at least 3° C./sec.

2) In the process of production of a high strength galvannealed steel sheet as set forth in any of the above (1) to (5), the sheet is cooled from the maximum reached temperature to 650° C. by an average cooling rate of 0.5 to 10° C./sec and then from 650° C. to 500° C. by an average cooling rate of at least 3° C./sec and further from 500° C. by an average cooling rate of at 0.5° C./sec from 420° C. to 460° C. and held from 500° C. to the plating bath for 25 sec to 240 sec, then hot-dip galvanizing is carried out.

3) In the process of production of a,high strength galvannealed steel sheet as set forth in any of the above (1) to (5), the time until cooling to a temperature of not more than 400° C. after the hot-dip galvanizing is made 30 sec to 120 sec.

4) In the process of production of a high strength galvannealed steel sheet as set forth in any of the above (1) to (5), the sheet is cooled to 400° C. to 450° C. after annealing, then reheated from 430° C. to 470° C. and hot-dip galvanizing is carried out.

BEST MODE FOR WORKING THE INVENTION

Figure 1:
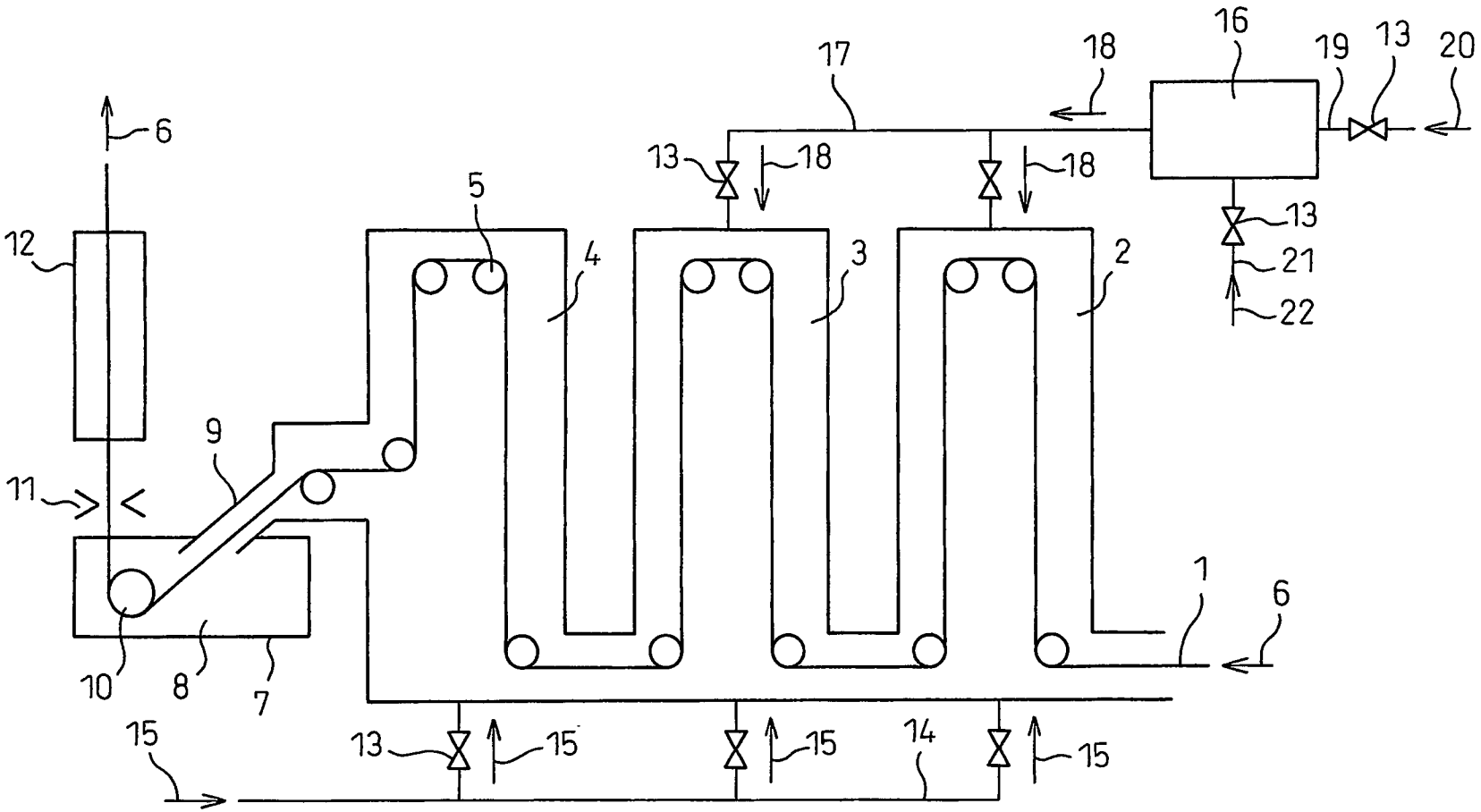
FIG. 1 is a side view of an example of a production system for hot-dip galvanized steel sheet according to the present invention.

Below, the present invention will be explained in further detail.

The present invention comprises continuously hot-dip galvanized high strength steel sheet having a content of Si of 0.4 to 2.0 wt % by a hot-dip galvanized steel sheet production system using an all radiant tube type annealing furnace during which making the atmosphere of the reducing zone is made one which does not cause iron to oxidize and causes internal oxidation of $SiO_2$. Here, "internal oxidation of Si" is a phenomenon where the oxygen diffused in the steel sheet reacts with Si near the surface layer of the alloy and precipitates as an oxide. The phenomenon of internal oxidation occurs when the rate of diffusion of the oxygen inward is far faster than the rate of diffusion of the Si outward, that is, when the oxygen potential in the atmosphere is relatively high. At this time, the Si does not move much at all and is oxidized in place, so the cause of the drop in plating adhesion, that is, the concentration of Si at the surface of the steel sheet, can be prevented.

Specifically, the invention comprises making the atmosphere of the reducing zone an atmosphere containing $H_2$ to 1 to 60 wt % and comprised of the balance of $N_2$, $H_2O$, $_{02}$, $CO_2$, CO, and unavoidable impurities, controlling the log ($PCO_2/PH_2$) of the carbon dioxide partial pressure and hydrogen partial pressure in the atmosphere to log ($PCO_2/PH_2$) $\leqq -0.5$ and the log ($PH_2O/PH_2$) of the water partial pressure and hydrogen partial pressure to log ($PH_2O/PH_2$) $\leqq -0.5$, controlling the log ($P_T/PH_2$) of the total partial pressure $P_T$ of the carbon dioxide partial pressure $PCO_2$ and water partial pressure $PH_2O$ and the hydrogen partial pressure to $-3\log (P_T/PH_2) \leqq -0.5$, and performing the annealing in the reducing zone in a ferrite-austenite two-phase temperature region at 720° C. to 880° C.

In the reducing zone, a gas including $H_2$ in the range of 1 to 60 wt % is used. The reason for limiting the $H_2$ to 1% to 60% is that if less than 1%, the oxide film produced at the surface of the steel sheet before annealing cannot be sufficiently reduced and the plating wettability cannot be secured, while if over 60%, no improvement in the reducing action can be. seen and the cost is increased.

Further, in the reducing zone, for the purpose of causing internal oxidation of $SiO_2$, one or two or more of $H_2O$, $O_2$, $CO_2$, and CO are introduced into the reducing atmosphere, the log ($PCO_2/PH_2$) of the carbon dioxide partial pressure and hydrogen partial pressure in the atmosphere is controlled to log ($PCO_2/PH_2$)$\leqq -0.5$ and the log ($PH_2O/PH_2$) of the water partial pressure and hydrogen partial pressure to log ($PH_2O/PH_2$)$\leqq -0.5$, and the log ($P_T/PH_2$) of the total partial pressure $P_T$ of the carbon dioxide partial pressure $PCO_2$ and water partial pressure $PH_2O$ and the hydrogen partial pressure is controlled to $-3 \log (P_T/PH_2) \leqq -0.5$.

The log ($PCO_2/PH_2$) of the carbon dioxide partial pressure and hydrogen partial pressure and the log ($PH_2O/PH_2$) of the water partial pressure and hydrogen partial pressure are controlled by introducing $CO_2$ and water vapor into the furnace.

The reason for making the log($PCO_2/PH_2$) not more than −0.5 is that if the log($PCO_2/PH_2$) is over −0.5, the oxide film which had been produced on the surface of the steel sheet before annealing cannot be sufficiently reduced and the plating wettability cannot be secured. Further, the reason for making the log($PH_2O/PH_2$) not more than −0.5 is that if the log($PH_2O/PH_2$) is over −0.5, the oxide film which had been produced on the surface of the steel sheet before annealing cannot be sufficiently reduced and the plating wettability cannot be secured.

The reason for making the log($P_T/PH_2$) of the carbon dioxide partial pressure $PCO_2$ and the water partial pressure $PH_2O$ and the hydrogen partial pressure not more than −0.5 is that if the log($P_T/PH_2$) is over −0.5, the oxide film which had been produced on the surface of the steel sheet before annealing cannot be sufficiently reduced and the plating wettability cannot be secured. Further, the reason for making the $\log(P_T/PH_2)$ not less than −3 is that if the $\log(P_T/PH_2)$ is less than −3, external oxidation of the Si occurs, $SiO_2$ is produced on the surface of the steel sheet, and the plating wettability is caused to fall.

$O_2$ and CO do not have to be deliberately introduced, but when introducing $H_2O$ and $CO_2$ into the furnace of the main annealing temperature and atmosphere, parts are reduced by $H_2$ and $O_2$ and CO are produced.

$H_2O$ and $CO_2$ need only be introduced in the required amounts. The method of introduction is not particularly limited, but the method of burning a gas comprised of a mixture of for example CO and $H_2$ and introducing the produced $H_2O$ and $CO_2$, the method of burning a gas of $CH_4$, $C_2H_6$, $C_8H_8$, or another hydrocarbon or a mixture of LNG or another hydrocarbon and introducing the produced $H_2O$ and $CO_2$, the method of burning a mixture of gasoline, light oil, heavy oil, or another liquid hydrocarbon and introducing the produced $H_2O$ and $CO_2$, a method of burning $CH_3OH$, $CH_2H_5OH$, or another alcohol or its mixture or various types of organic solvents and introducing the produced $H_2O$ and $CO_2$, etc. may be mentioned.

The method of burning only CO and introducing the produced $CO_2$ may also be considered, but when introducing $CO_2$ into the furnace of the main annealing temperature and atmosphere, part is reduced by the $H_2$. There is no inherent difference from the case of introducing $H_2O$ and $CO_2$ to produce CO and $H_2O$.

Further, in addition to the method of introducing the $H_2O$ and $CO_2$ produced by burning, the method may also be used of introducing a gas of a mixture of CO and $H_2$, a gas of $CH_4$, $C_2H_6$, $C_8H_8$, or another hydrocarbon, a mixture of LNG or another hydrocarbon, a mixture of gasoline, light oil, heavy oil, or another liquid hydrocarbon, $CH_3OH$, $C_2H_5OH$, or another alcohol or their mixtures, and various types of organic solvents etc. simultaneously with oxygen into the annealing furnace and burning them in the furnace to produce, $H_2O$ and $CO_2$.

When annealing by an in-line annealing type continuous hot-dip galvanizing system, the annealing temperature is made a ferrite-austenite two-phase region of 720° C. to 880° C. If the annealing temperature is less than 720° C., the recrystallization is insufficient. The press workability required for steel sheet cannot be provided. By annealing by a temperature over 880° C., a rise in cost is invited, so this is not preferable.

Next, the steel strip is cooled by a process of dipping in a plating bath, but when not aiming at use of a member with particularly strict processing requirements, no special cooling process not be gone through. Hot-dip galvanizing is performed so as to form a hot-dip galvanizing layer on the surface of the steel sheet, then the steel sheet on which said hot-dip galvanizing layer is formed is heat treated for alloying at 460 to 550° C. so as to fabricate a high strength galvannealed steel sheet.

In particular, to achieve both a high strength and good press workability, the steel sheet to which Si or Mn has been added in a large amount is annealed, then cooled in the process of dipping into the plating bath from the maximum reached temperature to 650° C. by an average of 0.5 to 10° C/sec then cooled from 650° C. to the plating bath by an average of at least 3° C/sec. The cooling rate down to 650° C. is made an average 0.5 to 10° C/sec to increase the percent volume of the ferrite for improving the workability and simultaneously increase the C concentration of the austenite to lower the free energy produced and make the temperature of start of the martensite transformation not more than the plating bath temperature. To make the average cooling rate down to 650° C. less than 0.5° C/sec, it is necessary to make the line length of the continuous hot-dip galvanizing manufacturing equipment longer and the cost becomes high, so the average cooling rate down to 650° C. is made at least 0.5° C/sec.

To make the average cooling rate down to 650° C. less than 0.5° C./sec, it may be considered to lower the maximum reached temperature and anneal at a temperature with a small percent volume of austenite, but in this case the suitable temperature range is narrower than the temperature range allowed in actual operation and if the annealing temperature is even slightly low, austenite will not be formed and the object will not be achieved.

On the other hand, if the average cooling rate up to 650° C. is made to exceed 10° C./sec, not only will the increase in the percent volume of the ferrite be insufficient, but also the increase in the C concentration in the austenite will be small, so before the steel strip is dipped in the plating bath, part of it will transform to martensite and that martensite will be tempered and precipitate as cementite by the subsequent heating for alloying, so achievement of both high strength and good workability will become difficult.

The average cooling rate from 650° C. to the plating bath is made at least 3° C./sec to avoid the austenite being transformed to pearlite in the middle of the cooling. With a cooling rate of less than 3° C./sec, the sheet is annealed at a temperature defined in the present invention. Further, even if cooling down to 650° C., formation of pearlite is unavoidable. The upper limit of the average cooling rate is not particularly limited, but cooling the steel strip so that the average cooling rate does not exceed 20° C./sec is difficult in a dry atmosphere.

Further, to produce a high strength galvannealed steel sheet with good workability, the sheet is cooled by an average cooling rate from 650° C. to 500° C. of at least 3° C./sec, further cooled by an average cooling rate from 500° C. of at least 0.5° C./sec down to 420° C. to 460° C., held from 500° C. to the plating bath for 25 sec to 240 sec, then hot-dip galvanizing is carried out.

The average cooling rate from 650° C. to 500° C. was made at least 3° C./sec to avoid the austenite being transformed to pearlite in the middle of the cooling. With a cooling rate of less than 3° C./sec, even if annealing at the temperature defined in the present invention or cooling down to 650° C., formation of pearlite is unavoidable. The upper limit of the average cooling rate is not particularly limited, but cooling the steel strip so as not to exceed an average cooling rate of 20° C./sec is difficult in a dry atmosphere.

The average cooling rate from 500° C. is made at least 0.5° C./sec so as to avoid the austenite transforming to pearlite in the middle of the cooling. With a cooling rate of less than 0.5° C./sec, even if annealing at the temperature defined in the present invention or cooling down to 500° C., formation of pearlite is unavoidable. The upper limit of the average cooling rate is not particularly limited, but cooling the steel strip so as not to exceed an average cooling rate of 20° C./sec is difficult in a dry atmosphere. Further, the cooling end temperature was made 420 to 460° C. so as to promote concentration of C in the austenite and obtain a high strength alloyed molten zinc plating superior in workability.

The reason for limiting the maintaining time of below 25 seconds and less than 240 seconds between 500° C. and a temperature of the plating bath is that when the maintaining tine is below 25 seconds, the concentration of C in the austenite is insufficient and the concentration of C it the austenite does not reach the level enabling residual presence of austenite at room temperature. If over 240 sec, the bainite transformation does not proceed too much, the amount of austenite becomes smaller, and a sufficient amount of residual austenite cannot be produced.

Further, the sheet is cooled all at once to a temperature of 400 to 450° C. while being held from 500° C. to the plating bath. When held, the concentration of C in the austenite is promoted and a high strength alloyed molten zinc plating superior in workability is obtained. However, if continuing to immerse the sheet in the plating bath at under 430° C., the plating bath is cooled and solidifies, so it is necessary to reheat it to a temperature of 430 to 470° C., then perform the hot-dip galvanizing.

In the production of the galvannealed steel sheet of the present invention, to produce a high strength galvannealed steel sheet with a good workability, the hot-dip galvanizing bath used should be adjusted to an Al concentration of an effective Al concentration C in the bath of 0.07 to 0.092 wt %. Here, the effective Al concentration in the plating bath is the value of the Al concentration in the bath minus the concentration of Fe in the bath.

The reason for limiting the effective Al concentration 0.07 to 0.092 wt % is that if the effective Al concentration is less than 0.07%, the formation of the Fe—Al—Zn phase serving as the alloying barrier at the start of plating is insufficient and a brittle F phase is formed thickly at the interface of the plated steel sheet at the time of the plating, so only an galvannealed steel sheet with an inferior plating coating bonding force at the time of working can be obtained. On the other hand, if the effective Al concentration is higher than 0.092%, alloying at a high temperature for a long time becomes necessary, the austenite remaining in the steel transforms into pearlite, and therefore realization of both high strength and good workability become difficult. Further, making the alloying temperature at the time of the alloying in the present invention a temperature T (° C.) satisfying $$450 \leqq T \leqq 410 \times \exp(2 \times [\text{Al}\,\%])$$

where, [Al %]: effective Al concentration (wt %) in hot-dip galvanizing bath is effective for the production of high strength galvannealed steel sheet with a good workability.

The reason for making the alloying temperature at least 450° C. to not more than 410×exp(2×[Al %])° C. is that if the alloying temperature T is lower than 450° C., the alloying will not proceed or the alloying will proceed insufficiently, the alloying will be incomplete, and the plating layer will be covered with an η phase inferior in bondability. Further, if T is higher than 410×exp(2×[Al %])° C., the alloying will proceed too much and a brittle Γ phase is formed thickly at the interface of the plated steel sheet, so the plating bonding strength at the time of the working falls.

In the present invention, if the alloying temperature is too high, the austenite remaining in the steel transforms to pearlite and it is difficult to obtain steel sheet achieving both high strength and good workability. Therefore, the greater the amount of Si added and the more difficult the alloying, the more effective lowering the effective Al concentration in the bath and lowering the alloying temperature are for improving the workability.

Specifically, the plating is performed at an effective Al concentration (wt %) in the bath satisfying $$[\text{Al}\,\%]) \leqq 0.092 - 0.001 \times [\text{Si}\,\%]^2$$

where, [Si %]: Si content in steel sheet (wt %).

The reason for limiting the effective Al concentration to not more than 0.092−0.001×[Si %]2% is that if the effective Al concentration is higher than $0.092-0.001\times[\text{Si}\,\%]^2$%, alloying at a high temperature and a long time becomes required, the austenite remaining in the steel transforms to pearlite, and the workability deteriorates.

The reason for making the time until cooling to a temperature of not more than 400° C. after hot-dip galvanizing to 30 sec to 120 sec is that if less than 30 sec, the alloying is insufficient, the alloying becomes incomplete, and the surface layer of the plating is covered by an η phase inferior in bondability, while if over 120 sec, the pearlite transformation proceeds too much, the amount of austenite becomes small, and a sufficient amount of residual austenite cannot be produced.

Figure 2:
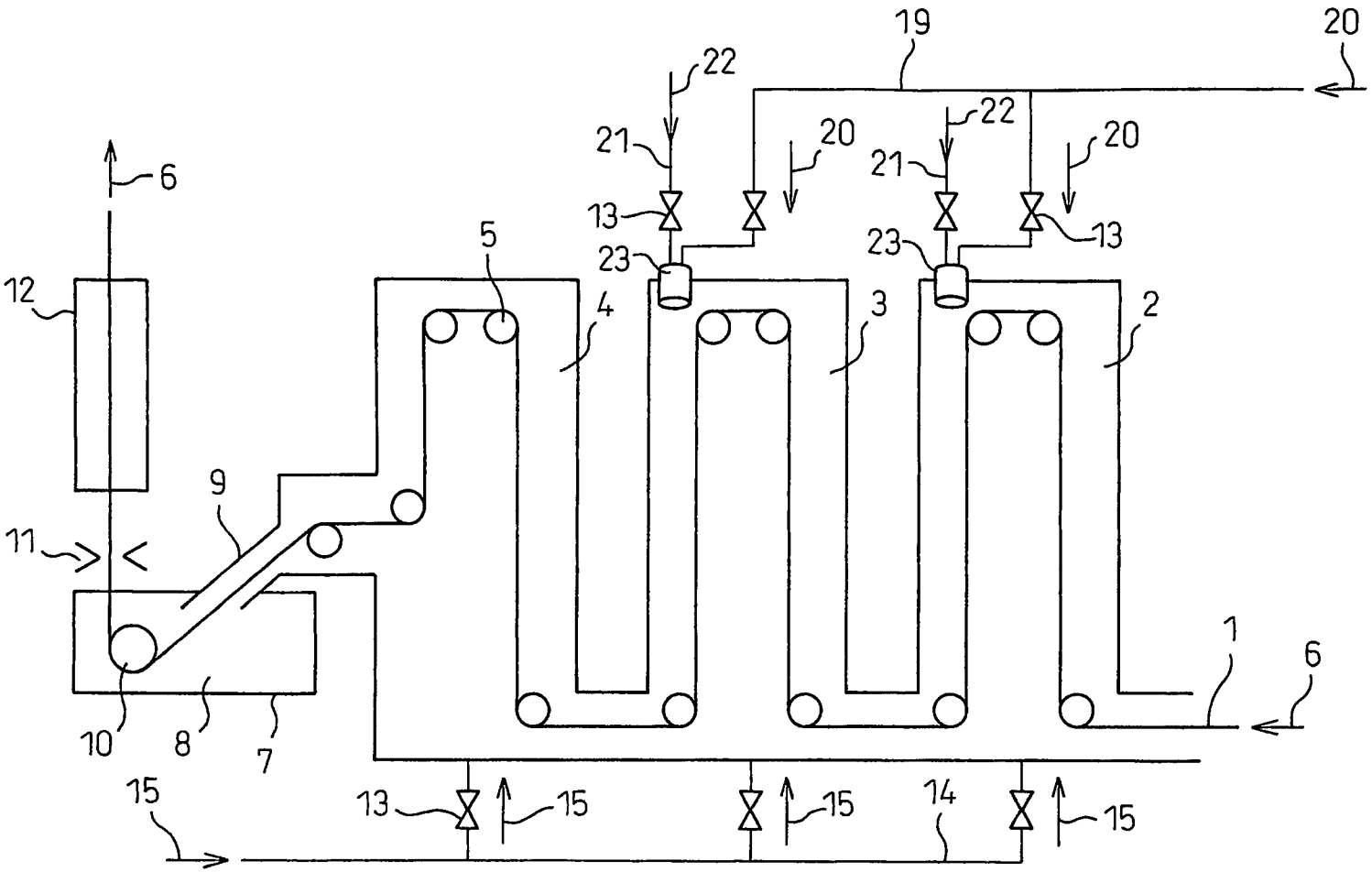
FIG. 2 is a side view of an example of a production system for hot-dip galvanized steel sheet according to the present invention.

FIG. 1 and FIG. 2 show an example of a manufacturing equipment of hot-dip galvanized steel sheet according to the present invention by a side view. In the figures, 1 indicates a high strength steel sheet having a content of Si of 0.4 to 2.0 wt %, 2 a heating zone of the annealing furnace, 3 a soaking zone of the annealing furnace, 4 a cooling zone of the annealing furnace, 5 an in-furnace roll, 6 a steel sheet advance direction, 7 a hot-dip galvanizing tank, 8 molten zinc, 9 a snout, 10 a sink roll, 11 a gas wiping nozzle, 12 an alloying furnace, 13 a gas flow adjustment valve, 14 a reducing gas pipe, 15 a reducing gas flow direction, 16 a burner, 17 a combustion gas pipe, 18 a combustion gas flow direction, 19 a fuel gas pipe, 20 a fuel gas flow direction, 21 an air pipe, 22 an air flow direction, and 23 a burner provided in the furnace.

EXAMPLE 1

A slab comprised of the composition shown by R in Table 1 was heated to 1150° C. to obtain a hot rolled steel strip of 4.5 mm of a finishing temperature of 910 to 930° C. This was wound up at 580 to 680° C. The strip was pickled, then cold rolled to obtain a cold rolled steel strip of 1.6 mm, then a continuous hot-dip galvanizing equipment using an all radiant tube type annealing furnace was used for the heat treatment and plating under the conditions such as shown in Table 2 to produce a galvannealed steel sheet. The continuous hot-dip galvanizing equipment was provided with an apparatus for burning a gas comprised of a mixture of CO and $H_2$ and introducing the produced $H_2O$ and $CO_2$ and adjusted the $\log(P_T/PH_2)$ of the total partial pressure $P_T$ of the carbon dioxide partial pressure $PCO_2$ and water partial pressure $PH_2O$ and the hydrogen partial pressure to become the value shown in Table 2.

The tensile strength (TS) and elongation (El) were found by cutting out JIS No. 5 test pieces from the steel sheets and performing tensile tests at ordinary temperature.

The amount of deposition of the plating was determined by dissolving the coating film in hydrochloric acid in an inhibitor and measuring it by the weight method.

The wettability was judged by scoring the percent area of plating gaps of the rolled coil as follows. A score of 3 or more was judged as passing.

4: percent area of plating gaps of less than 1%

3: percent area of plating gaps of 1% to less than 5%

2: percent area of plating gaps of 5% to less than 10%

1: percent area of plating gaps of 10% or more

The results of evaluation are shown in Table 2. No. 1 had a $\log(P_T/PH_2)$ of the total partial pressure $P_T$ of the carbon dioxide partial pressure $PCO_2$ and water partial pressure $PH_2O$ and the hydrogen partial pressure outside of the scope of the present invention, so the oxide film produced on the surface of the steel sheet before annealing could not be sufficiently reduced and the plating wettability was judged as failing. No. 7 had a $\log(P_T/PH_2)$ of the total partial pressure $P_T$ of the carbon dioxide partial pressure $PCO_2$ and water partial pressure $PH_2O$ and the hydrogen partial pressure outside of the scope of the present invention, so external oxidation of Si occurred, $SiO_2$ was produced on the surface of the steel sheet, and the plating wettability was judged as failing.

The rest of the steel sheets, those produced by the process of the present invention, were high strength galvannealed steel sheets superior in plating wettability.

EXAMPLE 2

A slab comprised of the composition shown in Table 1 was heated to 1150° C. to obtain a hot rolled steel strip of 4.5 mm of a finishing temperature of 910 to 930° C. This was wound up at 580 to 680° C. The strip was pickled, then cold rolled to obtain a cold rolled steel strip of 1.6 mm, then a continuous hot-dip galvanizing equipment using an all radiant tube type annealing furnace was used for the heat treatment and plating under the conditions such as shown in Table 3 to produce a galvannealed steel sheet. The continuous hot-dip galvanizing equipment was provided with an apparatus for burning a gas comprised of a mixture of CO and $H_2$ and introducing the produced $H_2O$ and $CO_2$ and adjusted the $\log(P_T/PH_2)$ of the total partial pressure $P_T$ of the carbon dioxide partial pressure $PCO_2$ and water partial pressure $PH_2O$ and the hydrogen partial pressure to become −1 to −2.

The tensile strength (TS) and elongation (El) were found by cutting out JIS No. 5 test pieces from the steel sheets and performing tensile tests at ordinary temperature.

The amount of deposition of the plating was determined by dissolving the coating film in hydrochloric acid in an inhibitor and measuring it by the weight method.

The wettability was judged by scoring the percent area of plating gaps of the rolled coil as follows:

4: percent area of plating gaps of less than 1%
3: percent area of plating gaps of 1% to less than 5%
2: percent area of plating gaps of 5% to less than 10%
1: percent area of plating gaps of 10% or more The results of evaluation are shown in Table 3. Using the process of the present invention, it becomes possible to produce a high strength galvannealed steel sheet superior in plating wettability.

In particular, the processes of production shown in Nos. 4, 5, 6, 10, 11, 13, 14, 16, 17, 20, 21, 22, 25, 31, 32, 34, 35, and 36 had suitable cooling rates in the annealing furnace, effective Al concentrations in the hot-dip galvanizing bath, and alloying temperatures, so were able to produce high strength hot-dip galvanizing steel sheet with good workabilities.

TABLE 1

| | Chemical composition (wt %) | | | | | | | | |
|---|---|---|---|---|---|---|---|---|---|
| Symbol | C | Si | Mn | P | S | Al | N | Ni | Cu |
| A | 0.02 | 0.73 | 1.87 | 0.006 | 0.004 | 0.045 | 0.0023 | | |
| B | 0.08 | 1.83 | 2.35 | 0.004 | 0.005 | 0.063 | 0.0030 | 1.5 | |
| C | 0.07 | 0.40 | 2.21 | 0.036 | 0.002 | 0.040 | 0.0032 | | |
| D | 0.07 | 0.43 | 2.18 | 0.011 | 0.002 | 0.035 | 0.0028 | | |
| E | 0.07 | 0.64 | 0.95 | 0.009 | 0.004 | 0.029 | 0.0040 | | |
| F | 0.07 | 0.66 | 1.55 | 0.006 | 0.003 | 0.283 | 0.0026 | | |
| G | 0.07 | 0.71 | 2.08 | 0.004 | 0.002 | 0.031 | 0.0030 | | |
| H | 0.07 | 1.14 | 1.95 | 0.007 | 0.003 | 0.037 | 0.0027 | | |
| I | 0.08 | 1.65 | 1.80 | 0.008 | 0.003 | 0.027 | 0.0035 | | |
| J | 0.10 | 0.69 | 2.32 | 0.009 | 0.004 | 0.044 | 0.0033 | | |
| K | 0.14 | 0.50 | 1.61 | 0.013 | 0.005 | 0.038 | 0.0042 | | |
| L | 0.13 | 0.40 | 2.11 | 0.011 | 0.003 | 0.026 | 0.0036 | | |
| M | 0.14 | 0.82 | 2.27 | 0.008 | 0.002 | 0.054 | 0.0034 | | |
| N | 0.14 | 0.60 | 2.90 | 0.016 | 0.005 | 0.028 | 0.0045 | | |
| O | 0.18 | 0.94 | 2.77 | 0.018 | 0.004 | 0.037 | 0.0039 | | |
| P | 0.08 | 1.83 | 2.35 | 0.004 | 0.005 | 0.063 | 0.0030 | | |
| Q | 0.09 | 1.78 | 1.13 | 0.008 | 0.001 | 0.29 | 0.0027 | | |
| R | 0.07 | 1.14 | 1.95 | 0.007 | 0.003 | 0.037 | 0.0027 | 0.5 | 0.1 |

TABLE 2

| Sample no. | Steel sheet no. | $\log(P_T/PH_2)$ | Effective Al conc. (%) | Bath temp. (° C.) | Galvannealing temp. (° C.) | Time until 400° C. (sec) | Tensile strength (MPa) | Elongation (%) | Plating deposition (g/m2) | Plating wettability | Remarks |
|---|---|---|---|---|---|---|---|---|---|---|---|
| 1 | R | −0.4 | 0.087 | 450 | 480 | 60 | 600 | 37 | 35 | 2 | Comp. ex. |
| 2 | R | −0.8 | 0.087 | 450 | 480 | 60 | 600 | 37 | 35 | 4 | Ex. of invention |
| 3 | R | −1.0 | 0.087 | 450 | 480 | 60 | 600 | 37 | 35 | 4 | Ex. of invention |
| 4 | R | −1.5 | 0.087 | 450 | 480 | 60 | 600 | 37 | 35 | 4 | Ex. of invention |
| 5 | R | −2.0 | 0.087 | 450 | 480 | 60 | 600 | 37 | 35 | 4 | Ex. of invention |
| 6 | R | −2.5 | 0.087 | 450 | 480 | 60 | 600 | 37 | 35 | 3 | Ex. of invention |
| 7 | R | −3.2 | 0.087 | 450 | 480 | 60 | 600 | 37 | 35 | 1 | Comp. ex. |

TABLE 3

| Sample no. | Steel sheet no. | Max. temp. reached at annealing (° C.) | Average cooling rate up to 650° C. (° C./sec) | Average cooling rate up to 500° C. (° C./sec) | Cooling end temp. (° C.) | Average cooling rate until end of cooling (° C./sec) | Holding time from 500° C. to plating bath (sec) | Effect Al conc. (%) |
|---|---|---|---|---|---|---|---|---|
| 1 | A | 770 | 5 | 15 | 450 | 10 | 5 | 0.088 |
| 2 | B | 830 | 2 | 4 | 450 | 1.7 | 30 | 0.085 |

TABLE 3-continued

| | | | | | | | | |
|---|---|---|---|---|---|---|---|---|
| 3 | C | 760 | 4 | 10 | 450 | 5 | 10 | 0.088 |
| 4 | D | 760 | 2 | 8 | 450 | 1.7 | 30 | 0.088 |
| 5 | D | 760 | 2 | 8 | 465 | 1.2 | 30 | 0.088 |
| 6 | D | 760 | 2 | 8 | 440 | 2 | 30 | 0.088 |
| 7 | D | 720 | 2 | 8 | 450 | 1.7 | 30 | 0.088 |
| 8 | D | 890 | 2 | 8 | 450 | 1.7 | 30 | 0.088 |
| 9 | E | 780 | 3 | 15 | 450 | 5 | 10 | 0.088 |
| 10 | F | 780 | 3 | 10 | 450 | 1.3 | 40 | 0.088 |
| 11 | F | 780 | 3 | 10 | 450 | 1.3 | 40 | 0.088 |
| 12 | F | 800 | 3 | 6 | 450 | 1.7 | 30 | 0.088 |
| 13 | G | 770 | 1 | 6 | 450 | 1.4 | 35 | 0.088 |
| 14 | G | 830 | 1 | 6 | 450 | 1.4 | 35 | 0.088 |
| 15 | G | 890 | 2 | 8 | 450 | 1.7 | 30 | 0.088 |
| 16 | H | 780 | 2 | 7 | 450 | 1.7 | 30 | 0.087 |
| 17 | H | 820 | 1 | 4 | 450 | 1.7 | 30 | 0.087 |
| 18 | H | 820 | 15 | 18 | 450 | 10 | 5 | 0.087 |
| 19 | H | 820 | 1 | 4 | 450 | 2.5 | 20 | 0.087 |
| 20 | H | 820 | 1 | 4 | 450 | 1.7 | 150 | 0.087 |
| 21 | I | 800 | 2 | 4 | 450 | 1.4 | 35 | 0.085 |
| 22 | J | 770 | 0.8 | 3 | 450 | 1 | 50 | 0.088 |
| 23 | K | 790 | 2 | 4 | 450 | 1.7 | 30 | 0.088 |
| 24 | L | 760 | 2 | 10 | 450 | 1.7 | 30 | 0.088 |
| 25 | M | 770 | 3 | 12 | 450 | 1.7 | 30 | 0.088 |
| 26 | M | 770 | 3 | 12 | 450 | 1.7 | 30 | 0.088 |
| 27 | M | 770 | 0.3 | 15 | 450 | 1.7 | 30 | 0.088 |
| 28 | M | 770 | 5 | 1 | 450 | 0.6 | 90 | 0.088 |
| 29 | N | 760 | 2 | 4 | 450 | 1.7 | 30 | 0.088 |
| 30 | O | 770 | 2 | 4 | 450 | 1.7 | 30 | 0.088 |
| 31 | P | 830 | 2 | 4 | 450 | 1.7 | 30 | 0.085 |
| 32 | P | 830 | 2 | 4 | 470 | 1.7 | 30 | 0.085 |
| 33 | P | 830 | 2 | 4 | 465 | 1.7 | 30 | 0.085 |
| 34 | Q | 830 | 2 | 4 | 450 | 1.7 | 30 | 0.085 |
| 35 | R | 800 | 2 | 7 | 450 | 1.7 | 30 | 0.087 |

| Sample no. | Bath temp. (° C.) | Galvannealing temp. (° C.) | Time until 400° C. (sec) | Tensile strength (MPa) | Elong. (%) | Plating deposition (g/m2) | Plating wettability | Remarks |
|---|---|---|---|---|---|---|---|---|
| 1 | 450 | 480 | 60 | 423 | 38 | 36 | 4 | Ex. of inv. |
| 2 | 450 | 480 | 60 | 875 | 27 | 37 | 4 | Ex. of inv. |
| 3 | 450 | 480 | 60 | 630 | 28 | 35 | 4 | Ex. of inv. |
| 4 | 450 | 480 | 60 | 597 | 35 | 37 | 4 | Ex. of inv. |
| 5 | 465 | 480 | 60 | 610 | 34 | 35 | 4 | Ex. of inv. |
| 6 | 440 | 480 | 60 | 595 | 35 | 38 | 4 | Ex. of inv. |
| 7 | 450 | 480 | 60 | 967 | 5 | 36 | 4 | Ex. of inv. |
| 8 | 450 | 480 | 60 | 566 | 18 | 38 | 4 | Ex. of inv. |
| 9 | 450 | 480 | 60 | 431 | 35 | 40 | 4 | Ex. of inv. |
| 10 | 450 | 470 | 60 | 543 | 38 | 35 | 4 | Ex. of inv. |
| 11 | 450 | 490 | 50 | 522 | 35 | 37 | 4 | Ex. of inv. |
| 12 | 450 | 530 | 50 | 516 | 26 | 38 | 4 | Ex. of inv. |
| 13 | 450 | 480 | 60 | 595 | 36 | 40 | 4 | Ex. of inv. |
| 14 | 450 | 465 | 70 | 734 | 28 | 36 | 4 | Ex. of inv. |
| 15 | 450 | 480 | 60 | 713 | 17 | 39 | 4 | Ex. of inv. |
| 16 | 450 | 480 | 60 | 600 | 37 | 35 | 4 | Ex. of inv. |
| 17 | 450 | 480 | 60 | 611 | 36 | 36 | 4 | Ex. of inv. |
| 18 | 450 | 480 | 60 | 718 | 14 | 39 | 4 | Ex. of inv. |
| 19 | 450 | 480 | 60 | 604 | 29 | 36 | 4 | Ex. of inv. |
| 20 | 450 | 460 | 60 | 627 | 39 | 36 | 4 | Ex. of inv. |
| 21 | 450 | 470 | 80 | 620 | 35 | 37 | 4 | Ex. of inv. |
| 22 | 450 | 480 | 60 | 777 | 29 | 38 | 4 | Ex. of inv. |
| 23 | 450 | 480 | 60 | 627 | 26 | 37 | 4 | Ex. of inv. |
| 24 | 450 | 480 | 60 | 683 | 22 | 36 | 4 | Ex. of inv. |
| 25 | 450 | 480 | 60 | 828 | 27 | 39 | 4 | Ex. of inv. |
| 26 | 450 | 530 | 50 | 670 | 18 | 41 | 4 | Ex. of inv. |
| 27 | 450 | 480 | 60 | 695 | 18 | 38 | 4 | Ex. of inv. |
| 28 | 450 | 480 | 60 | 645 | 19 | 35 | 4 | Ex. of inv. |
| 29 | 450 | 480 | 60 | 987 | 12 | 36 | 4 | Ex. of inv. |
| 30 | 450 | 480 | 60 | 1120 | 8 | 36 | 4 | Ex. of inv. |
| 31 | 450 | 480 | 60 | 875 | 27 | 37 | 4 | Ex. of inv. |
| 32 | 465 | 480 | 60 | 875 | 27 | 38 | 4 | Ex. of inv. |
| 33 | 465 | 520 | 60 | 798 | 21 | 38 | 4 | Ex. of inv. |
| 34 | 450 | 480 | 60 | 783 | 27 | 36 | 4 | Ex. of inv. |
| 35 | 450 | 480 | 60 | 600 | 37 | 35 | 4 | Ex. of inv. |

Industrial Applicability

According to the present invention, it becomes possible to provide a process for production for plating a high strength steel sheet having a content of Si of 0.4 to 2.0 wt % using a continuous hot-dip galvanizing equipment using an all radiant tube type annealing furnace and an apparatus for the same. The contribution to development of the industry is extremely great.

The invention claimed is:

1. A process of production of a high strength galvannealed steel sheet, comprising pickling a hot-rolled steel sheet having a content of Si of 0.4 to 2.0 wt %, then, cold-rolling the steel sheet, then, continuously hot-dip galvanizing the steel sheet in an all radiant tube type annealing furnace with a reducing atmosphere and without an oxidizing zone, wherein the all radiant tube type annealing furnace comprises a heating zone (2), a soaking zone (3), a cooling zone (4), a reducing gas pipe (14) connecting the heating zone (2), soaking zone (3), and cooling zone (4), and a combustion gas pipe (17) connecting the heating zone (2) and soaking zone (3), and in the all radiant tube type annealing furnace, a reducing gas (15) flows into the heating zone (2), soaking zone (3), and cooling zone (4), and a combustion gas (18) flows into the heating zone (2) and soaking zone (3), and the atmosphere is made not to cause iron to oxidize, during the continuously hot-dip galvanizing:

introducing the combustion gas (18) containing $CO_2$ in an amount of 1 to 100 wt % and a balance of $N_2$, $H_2O$, $O_2$, CO, and unavoidable impurities into the heating zone (2), and soaking zone (3) of the annealing furnace, making the atmosphere of the annealing furnace an atmosphere containing $H_2$ to 1 to 60 wt % and the balance being $N_2$, $H_2O$, $O_2$, $CO_2$, CO, and unavoidable impurities, controlling, in the atmosphere, (i) the $\log(PCO_2/PH_2)$ of the carbon dioxide partial pressure and hydrogen partial pressure to $\log(PCO_2/PH_2) \leqq -0.5$, (ii) the $\log(PH_2O/PH_2)$ of the water partial pressure and hydrogen partial pressure to $\log(PH_2O/PH_2) \leqq -0.5$, and (iii) the $\log(P_T/PH_2)$ of (a) the total partial pressure $P_T$ of the carbon dioxide partial pressure $PCO_2$, the water partial pressure $PH_2O$, and the hydrogen partial pressure $PH_2$ and (b) the hydrogen partial pressure $PH_2$ to $-3 \leqq \log(P_T/PH_2) \leqq -0.5$, performing annealing in the reducing atmosphere in a ferrite-austenite two-phase temperature region at 720° C. to 880° C., then cooling by a plating bath and performing molten zinc plating so as to form a hot-dip galvanizing layer on the surface of the steel sheet, and then heating for alloying the steel sheet on which the hot-dip galvanizing layer is formed at 460 to 550° C., so as to produce a high strength galvannealed steel sheet.

2. A process of production of a high strength galvannealed steel sheet as set forth in claim 1, characterized by performing the hot-dip galvanizing in a hot-dip galvanizing bath of a composition comprised of an effective Al concentration in the bath of at least 0.07 wt % and the balance being Zn and unavoidable impurities and performing the alloying at a temperature T (° C.) satisfying $450 \leqq T \leqq 410 \times \exp(2 \times [\text{Al } \%])$, where, [Al %]: effective Al concentration (wt %) in the hot-dip galvanizing bath.

3. A process of production of a high strength galvannealed steel sheet as set forth in claim 1, the effective Al concentration (wt %) in the bath satisfying $[\text{Al } \%] \leqq 0.092 - 0.001 \times [\text{Si } \%]^2$, where, [Si %]: Si content in steel sheet (wt %).

* * * * *

UNITED STATES PATENT AND TRADEMARK OFFICE

CERTIFICATE OF CORRECTION

PATENT NO. : 8,491,734 B2
APPLICATION NO. : 10/568997
DATED : July 23, 2013
INVENTOR(S) : Kazuhiko Honda et al.

It is certified that error appears in the above-identified patent and that said Letters Patent is hereby corrected as shown below:

In the Specification

Column 2, line 26, change "-3 log ($P_T/PH_2$) ≤ -0.5" to -- -3≤ log ($P_T/PH_2$) ≤ -0.5 --;

Column 2, line 41, change "log ($PCO_2/PH_2$) -0.5" to -- log ($PCO_2/PH_2$) ≤ -0.5 --;

Column 2, line 46, change "-3 log ($P_T/PH_2$) ≤ -0.5" to -- -3≤ log ($P_T/PH_2$) ≤ -0.5 --;

Column 3, line 45, change "of a, high" to -- of a high --;

Column 4, line 19, change "$N_2$, $H_2O$, $_{O2}$, $CO_2$" to -- $N_2$, $H_2O$, $O_2$, $CO_2$, --;

Column 4, line 27, change "-3 log ($P_T/PH_2$) ≤ -0.5" to -- -3≤ log ($P_T/PH_2$) ≤ -0.5 --;

Column 4, line 48, change "-3 log ($P_T/PH_2$) ≤ -0.5" to -- -3≤ log ($P_T/PH_2$) ≤ -0.5 --;

Column 7, line 26, change "a brittle F phase" to -- a brittle Γ phase --;

Column 7, line 67, change "0.092-0.001 × [Si%]2%" to -- 0.092-0.001 × $[Si\%]^2$% --.

Signed and Sealed this
Fifth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,491,734 B2
APPLICATION NO. : 10/568997
DATED : July 23, 2013
INVENTOR(S) : Honda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 792 days.

Signed and Sealed this
Eighth Day of September, 2015

Michelle K. Lee

Michelle K. Lee
*Director of the United States Patent and Trademark Office*